United States Patent [19]

Mingrone

[11] Patent Number: 4,524,835

[45] Date of Patent: Jun. 25, 1985

[54] FIRE SUPPRESSION SYSTEMS

[76] Inventor: Frank V. Mingrone, 67 Nels Rd., Milford, Conn. 06460

[21] Appl. No.: 470,439

[22] Filed: Feb. 28, 1983

Related U.S. Application Data

[63] Continuation-in-part of Ser. No. 229,792, Jan. 30, 1981, abandoned.

[51] Int. Cl.[3] ..... A62C 37/00

[52] U.S. Cl. ..... 169/65; 169/16; 138/37

[58] Field of Search ..... 169/65, 54, 58, 59, 169/15, 16, 26; 138/37, 39; 285/156, 210

[56] References Cited

U.S. PATENT DOCUMENTS

| | | | |
|---|---|---|---|
| 712,859 | 11/1902 | Sheermesser | 138/37 |
| 759,750 | 5/1904 | Rosenthal | 137/205.5 |
| 1,086,143 | 2/1914 | Davidson | 138/37 |
| 1,390,047 | 9/1921 | Lange | 138/37 |
| 2,141,797 | 12/1938 | Minella | 285/210 |
| 2,376,412 | 5/1945 | Arthur | 138/37 |
| 2,423,633 | 7/1947 | Baden | 138/37 |
| 2,486,141 | 10/1949 | Follo | 138/37 |
| 2,708,605 | 5/1955 | Guise et al. | 302/66 |
| 3,068,904 | 12/1962 | Moody | 138/37 |
| 3,356,148 | 12/1967 | Jamison | 169/15 |
| 3,407,879 | 10/1968 | O'Rear | 169/9 |
| 3,419,083 | 12/1968 | Cholin et al. | 169/26 |
| 3,463,233 | 8/1969 | Haessler | 169/1 |
| 3,463,236 | 8/1969 | Flajole et al. | 169/42 |
| 3,584,688 | 6/1971 | Duncan | 169/2 |
| 3,606,169 | 9/1971 | West | 239/597 |
| 3,653,443 | 4/1972 | Dockery | 169/2 |
| 3,756,486 | 9/1973 | Howorth et al. | 138/37 |
| 3,772,499 | 11/1973 | Fritzsche | 219/490 |
| 3,824,374 | 7/1974 | Mayher | 219/510 |
| 3,889,754 | 8/1975 | Dunn | 169/59 |
| 3,889,757 | 8/1975 | Dunn | 169/59 |
| 4,061,192 | 12/1977 | Cholin et al. | 169/16 |

*Primary Examiner*—Joseph J. Rolla
*Assistant Examiner*—Kenneth Noland
*Attorney, Agent, or Firm*—Mattern, Ware, Stoltz & Fressola

[57] ABSTRACT

Fire suppression piping systems for delivering prescribed quantities of chemical powder propelled by compressed gas, such as dry nitrogen to extinguish fires occurring in commercial and industrial equipment, i.e. open tanks of flammable liquids, machinery handling flammable materials, pumping stations, or in restaurant kitchen appliances, incorporating storage cylinder means, individual nozzles positioned to deliver dry chemical powder to the site of flammable liquids, spills or to exposed surface of heated cooking oils, greases and fats in grills, ovens, deep fat fryers, charbroilers, exhaust plenum hoods or exhaust ducts, a continuous, non-bifurcated supply manifold, plurality of unique distribution orifice Tees, each connected to form an uninterrupted part of the supply manifold, for dispensing controlled quantities of dry chemical fire suppressant powder from the principal supply within the manifold to a corresponding plurality of lateral conduits each connected to one said orifice Tee for delivering fire suppressing powder to flammable liquids or grease fires.

9 Claims, 8 Drawing Figures

PRIOR ART

FIRE SUPPRESSION SYSTEMS

CROSS REFERENCE TO RELATED APPLICATION

This application is a continuation-in-part of my copending U.S. patent application, Ser. No. 229,792, filed Jan. 30, 1981 now abandoned.

TECHNICAL FIELD

This invention relates to fire suppression systems utilizing dry chemical powders delivered by compressed, non-oxidizing gas to charge a system of piping leading directly to cooking appliances, exhaust hoods, ducts and plenums in restaurant kitchens, where grease fires pose a significant safety hazard, or to other sites in industrial processing equipment involving the use of flammable liquids, pumping stations or chemical process plants where flammable liquid spills may occur. More particularly, this invention relates to novel piping systems utilizing unique distribution orifice Tees to subdivide the gas entrained dry chemical powder in predetermined quantities while minimizing reductions of powder flow. Desired volumes of dry chemical fire suppression powder are thus delivered to flammable liquid or grease fire locations rapidly with high degree of efficiency and control.

The use of such dry chemical fire suppression powder as sodium bicarbonate for restaurant cooking appliances delivered by compressed gas, usually dry nitrogen provides instant flame suppression and simultaneous saponification of hot layers of grease, changing the grease into a soap, retarding or preventing re-ignition. Whereas the chemical reaction of the powdered chemical at the surface of the burning liquid fuel is the major extinguishing mechanism, a very minor contribution is also made by the smothering displacement of oxygen from the fire by the nitrogen gas used as the propellant for the powder, and also by the cooling effect provided by its expansion from 350 p.s.i. to atmospheric pressure.

The following discussion relates to restaurant cooking appliance protection. The principles, however, apply to other aforementioned hazards.

BACKGROUND ART

Conventional fire suppression systems delivering dry chemical powder carried by compressed inert gas lack the versatility of standard liquid fire suppression systems such as water sprinkler systems. This is because dry chemical powder carried in a gas stream will separate from the transporting gas if the velocity falls below that value required to carry it along, due to the effect of gravity on the powder particles. It will also separate when the direction of travel is changed, as in passing through an elbow, due to the inertia of the powder particles, resulting in a higher concentration of powder on the far side of the pipe immediately downstream from the elbow. These unequal distributions of powder in such systems is fully documented in Guise U.S. Pat. No. 2,708,605.

Dry chemical powder carried in a gas stream must be delivered in effective quantities to each different fire location. Underwriters' Laboratories have verified tests demonstrating the desirability of imposing the requirement that the entire charge of dry powder must be delivered within a few seconds, for example, in specified minimum quantities to different cooking appliances in a restaurant kitchen. Thus, in a typical system, the exhaust duct nozzle must deliver 3.9 pounds, and plenum nozzles in the exhaust hood plenum must deliver 5.1 pounds. A nozzle protecting a charbroiler must deliver 4.0 pounds, and nozzles protecting other appliances such as deep fat fryers, small griddles and broiler grills must deliver 1.9 pounds, all within the minimum required discharge time.

In order to assure the delivery of these minimum quantities of dry chemical powder through the conventional piping system the powder-gas stream is divided in substantially equal portions and then subdivided again and again at equal-branching Tees. These forked or multiple-bifurcated piping systems have been considered necessary to assure substantially even division of the gas powder stream. In order to produce an unbalanced division and deliver more powder through one branch of the Tee, for example, to protect one or two appliances that require more powder, the opposite branch must have its flow hindered by the use of longer lengths and/or smaller sizes of pipe and added elbows. These are the present means of controlling the distribution of powder to assure that each appliance, deep fat fryer, grill, griddle, and broiler, receives at least its required minimum volume of fire suppressing powder while the exhaust hood, plenum and ducts were also assured of receiving their required minimum volumes of fire suppressing powder.

Piping is further complicated by the effect of inertia, as mentioned above, requiring that a branching Tee immediately downstream from an elbow must be oriented with its horns at right angles to the pipe upstream before the elbow or that a minimum distance equal to approximately 20 pipe diameters be placed between the elbow and the Tee, to allow the powder in the stream to approach homogeneity.

The result of these multiple-bifurcated branching piping systems with the extra pipe length and sizes, and added elbows has been increased cost and reduced efficiency. The multiple branches and added elbows actually duplicate runs of piping in horizontal directions as the powder-gas stream is delivered to a central point and then branched to first bifurcations, travelling thence to second and third bifurcations before it reaches the delivery nozzles. Moreover, the insertion of so many extra forking, branching Tees, elbows and otherwise unnecessary length of piping absorbs kinetic energy from the advancing gas-powder stream, building powder deposits in dead spots inside the piping system by reducing its velocity below that value which is required to suspend and carry the powder particles along, resulting in reduction of powder delivered to the nozzles at the end of the line. This often wastes the fire suppressing powder, because excess quantities must be delivered to various sites in order to assure that minimum quantities reach particular sites, such as more remote hazards, due to the inherent lack of better control of powder distribution.

DISCLOSURE OF INVENTION

The systems of the present invention eliminate bifurcated branching of the delivery piping systems for these dry chemical powder fire suppression installations by utilizing distribution orifice Tees inserted directly in a single, continuous, uninterrupted and unbranched supply manifold running directly from the storage cylinder along the entire length of the flammable liquid spill site or protected kitchen installation.

In practical usage, the typical kitchen installation will consist of a storage cylinder which may or may not be located remotely from the cooking arena, at distances ranging from 4 feet to perhaps 50 feet, with a straight or multi-direction single manifold extending the length of the cooking arena. Two separate cooking arenas or kitchens, not more than 50 feet apart, may be protected by a single storage cylinder. Two or more continuous, non-bifurcated supply manifolds may be supplied by the same storage cylinder from a central distribution point, which may be a conventional Tee fitting.

PRIOR ART

Conventional prior art restaurant fire suppression systems are shown and described in detail in U.S. Pat. Nos. 2,708,605 and 3,463,233, and components for such conventional systems are disclosed in U.S. Pat. Nos. 3,356,148; 3,407,879; 3,419,083; 3,463,236; 3,584,688; 3,606,169; 3,653,443; 3,772,499; 3,824,374; 3,889,754; 3,889,757; and 4,061,192. The distribution orifice Tees utilized in the systems of the present invention may be compared to piping components utilized in air delivery conduits and in steam or hot water radiator piping, as shown in U.S. Pat. Nos. 712,859; 759,750; 1,086,143; 2,141,797; 2,423,633; 2,486,141; and 3,068,904, except that they lack the capability to control the quantitative dispensing of a separate component in the flow medium. Whereas they were designed to carry one liquid, such as water, this invention is concerned with the quantitative delivery of solid particles carried by a gas in motion. Furthermore, their performance relies entirely on ram effect, that is, their openings or scoops must face directly into the flow of the liquid whereas the systems of this invention quantitatively distribute powder particles from a manifold filled with powder carried by the gas. The direction the orifice faces in my Tees is not critical but may be repositioned to produce varying results.

The multiple bifurcation employed and considered essential in prior art dry chemical piping systems is well illustrated in FIG. 12 of Guise U.S. Pat. No. 2,708,605, where the duplication of parallel piping conduits is clearly evident. This expensive redundancy is virtually eliminated by the present invention.

OBJECTS OF THE INVENTION

Accordingly, it is a principal object of the present invention to reduce energy losses, friction and deceleration in extra lengths of piping and unnecessary direction changing branching Tees in delivery piping for dry chemical powder fire suppression systems.

Another object of the invention is to increase the efficiency of such systems, allowing an increase in the number of nozzles or hazards that can be protected by a given amount of powder in the reservoir because of the aforementioned reduction in losses and improved control of the distribution of powder in the required amounts that are delivered to the various locations.

A further object of the present invention is to reduce excessive, costly and unnecessary piping redundancies in such fire suppression systems.

A further object of the invention is to reduce residual powder deposits tending to accumulate at the direction changing branch points of multiple-bifurcated prior art dry chemical powder piping delivery systems, and along unnecessary lengths of piping.

Another object of the invention is to provide dry chemical powder fire suppression piping delivery systems assuring desired powder volume delivery at each nozzle location rapidly after system actuation by minimizing delivery of superfluous powder to other locations.

Another object is to eliminate the need for extra lengths and sizes of pipe and added elbows to aid in the control of distribution of required amounts of powder to various discharge nozzles.

Other objects of the invention will in part be obvious and will in part appear hereinafter.

The invention accordingly comprises the features of construction, combinations of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings, in which:

BEST MODE FOR CARRYING OUT THE INVENTION

Figure 1:
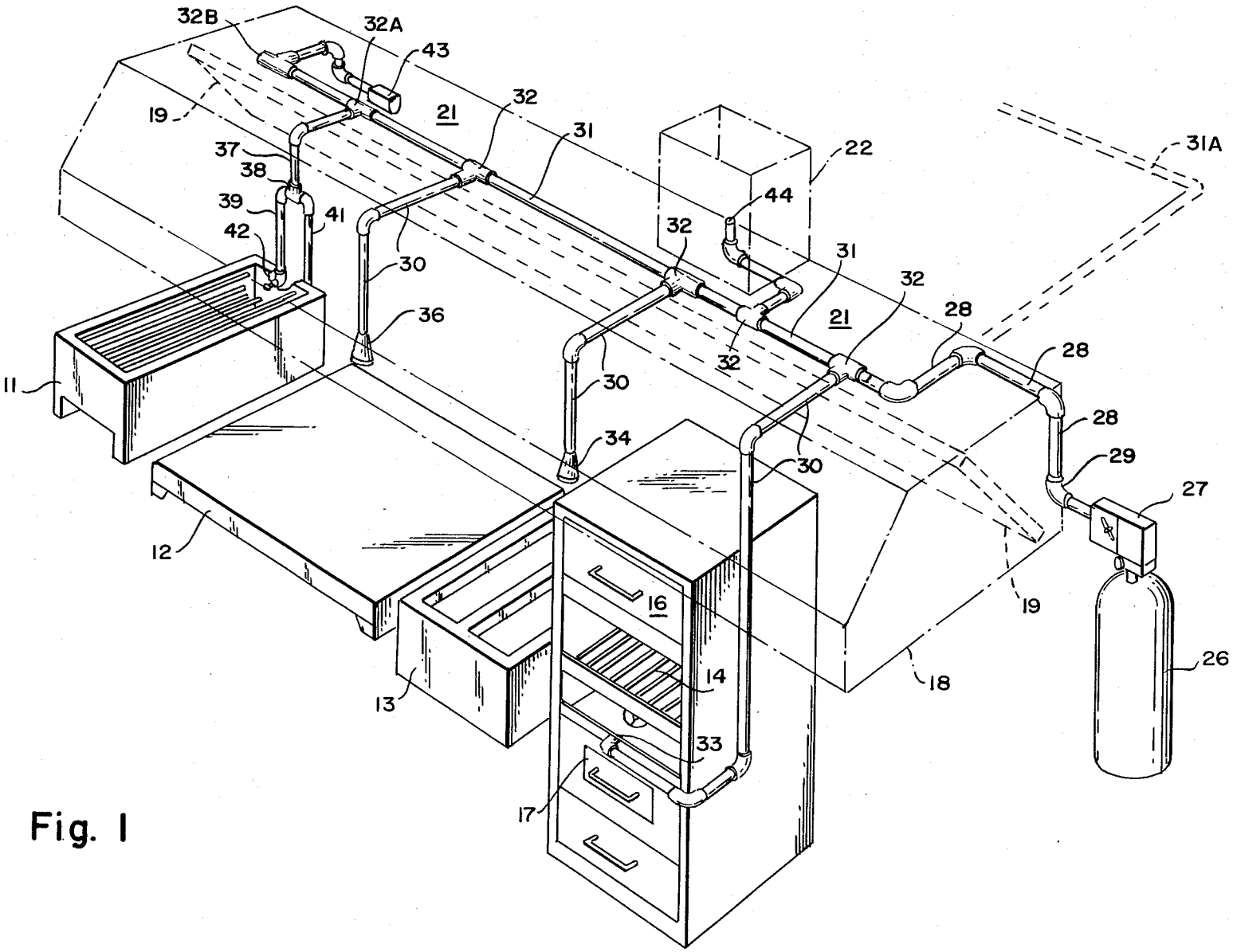
FIG. 1 is a diagrammatic perspective view of a typical restaurant kitchen installation with the various cooking appliances surmounted by an exhaust hood leading to an exhaust duct, with the entire installation protected by a fire suppression system of the present invention having a single un-forked manifold.

In the restaurant kitchen shown schematically in FIG. 1, a charbroiler 11, a griddle 12, a deep fat fryer 13 and a broiler-grill unit 14 surmounted by a warming oven 16 and having an underlying drip pan 17 are successively arrayed under an exhaust hood 18 shown in dash lines. A slanting rear array of filter screens 19 shown in dash lines encloses the upper rear portion of exhaust hood 18, forming an exhaust plenum 21 communicating directly with the exhaust duct 22.

The fire suppression system of the present invention is installed in close juxtaposition to each of the foregoing components of the restaurant kitchen installation. The storage cylinder 26 surmounted by an actuator assembly or control head 27, which is adapted for manual triggering or automatic actuation in response to automatic fusible link heat sensors, is directly connected through short lengths of piping 28 and elbows or "ells" 29 to a central continuous supply manifold 31 extending along the entire length of hood 18.

It will be observed in FIG. 1 that continuous supply manifold 31 is not forked or bifurcated at any point along its length. Instead, the dry chemical powder carried by compressed dry nitrogen gas, delivered by storage cylinder 26 whenever actuator 27 is actuated, completely fills the entire length of supply manifold conduit 31.

The powder in the manifold is dispensed by the distribution orifice Tees to the branch lines in accordance with the preselected sizes of orifices incorporated in each of the Tees. The orifice sizes are determined by the number and types of nozzles in a given system, and by the back-pressure or "feed-back" effect created by these nozzles.

In the system illustrated in FIG. 1, the first three orifice Tees 32 are each connected to a lateral conduit or discharge point line 30 leading directly to a single nozzle. The first of these nozzles 33 is directed under the broiler-grill 14 and above its underlying drip pan 17. The second nozzle 34 overlies the deep fat fryer 13. The third nozzle 36 is centered directly above the griddle 12.

The fourth distribution orifice Tee 32A shown at the upper lefthand portion of FIG. 1, at the left end of supply manifold 31, is connected to a lateral conduit 37 incorporating a bifurcation or fork Tee fitting 38 delivering the divided powder stream from lateral conduit 37 through parallel conduits 39 and 41 to a pair of nozzles 42 directed beneath the grill and above the briquets in charbroiler 11, where dripping fat is most likely to catch fire.

A final distribution orifice Tee 32B at the remote end of supply manifold 31 delivers the balance of the powder through a final lateral conduit to plenum nozzle 43, positioned to deliver the powder down the length of plenum 21, and an intermediate distribution orifice Tee 32 at a central location along conduit 31 delivers its subdivided portion of the powder to a duct nozzle 44 positioned in the duct 22.

Figure 2:
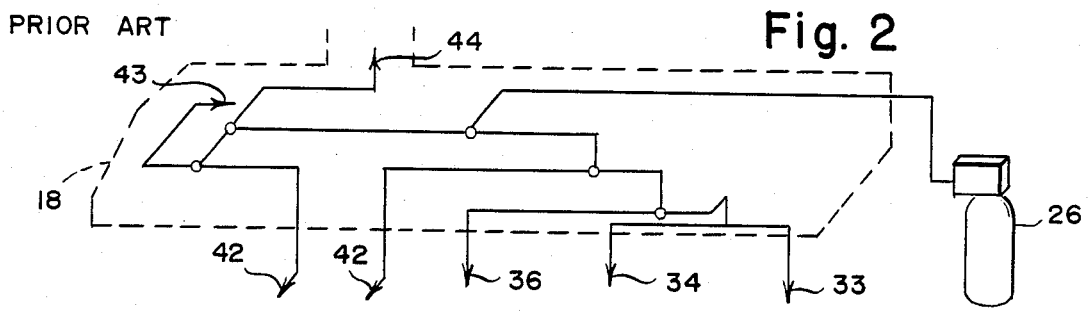
FIG. 2 is a schematic line diagram of a comparable conventional multiple-bifurcated piping system for delivering dry chemical powder in compressed gas to a similar restaurant kitchen, illustrating a typical prior art piping system and showing numerous redundant horizontal runs of piping.

In the prior art system shown schematically in FIG. 2, the seven nozzles 33, 34, 36, 42, 43 and 44 are all positioned in the same locations as the corresponding nozzles in the embodiment of the invention illustrated in FIG. 1. It is evident from the schematic diagram of FIG. 2, however, that prior art bifurcated piping systems duplicate two or three or even four horizontal piping runs over substantial segments of the system. These duplicate piping runs are caused by forking and reforking of the piping in order to divide, subdivide and re-subdivide the powder delivered by the system with minimum differences in powder concentrations in the propellant gas.

When a fire hazard is divided, as in separate kitchen areas served by a common exhaust duct, storage cylinder 26 may be connected to a central point in a conduit 31 serving both areas. This central connection is shown schematically in FIG. 1, where the opposite end of conduit 31 is shown in dash lines 31A, leading to another restaurant kitchen installation similar to that shown in this view of the drawings.

DISTRIBUTION ORIFICE TEES

Figure 3:
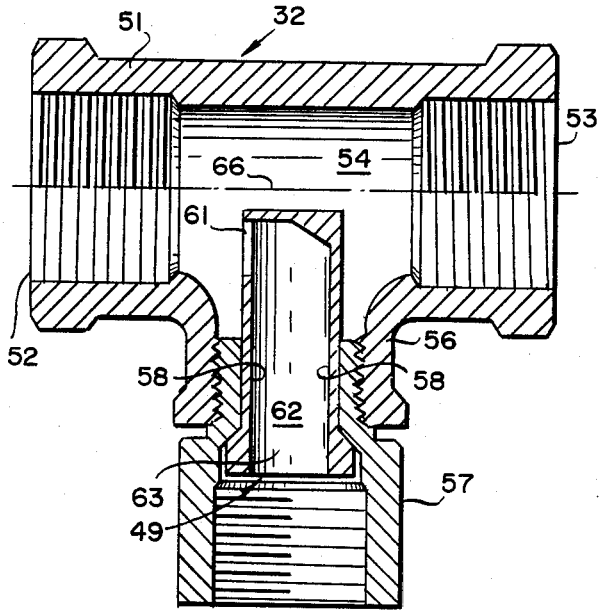
FIG. 3 is a cross-sectional elevation view of a distribution orifice Tee, a unique component incorporated in the piping systems of this invention.

The preferred form of distribution orifice Tee 32 characterizing the present invention is illustrated in FIG. 3 and comprises a hollow tubular central body portion 51 provided with threaded end portals 52 and 53 joined by a central hollow tubular passageway 54. Portals 52 and 53 are threaded for pipe fitting installation on the conventional pipe threads of segments of three-quarter inch piping forming supply manifold 31. The through passageway 54 is thus connected with these pipe segments to form an uninterrupted supply manifold 31. Mounted in threaded engagement with the lateral outlet 56 of distribution orifice Tee 32 is a threaded nipple or adapter 57 provided with a smooth internal bore.

Installed by a force fit inside the bore is an orifice insert 49 shown in cross-section in FIG. 3, and similar inserts are illustrated in FIGS. 4, 5, 6 and 7. Each of these inserts is a sturdy, tubular, cylindrical part 58 having a side entrance portal 61 near its closed upper end, opening into a hollow central bore 62 having an open lower end 63. The outer cylindrical surface 64 of the insert 49 has an outer diameter selected for an interfering force fit inside the internal diameter of the bore of adapter nipple 57. After the adapter nipple 57 is installed in the lateral outlet 56, orifice insert 49, with its lateral entrance portal 61 facing directly upstream, is installed by being driven home through the internal bore into seated force fitted engagement with the nipple adapter 57, bringing its upper end into juxtaposition with the central axis 66 of the passageway 54. In use, the lateral outlet 56 of any Tee 32 may face vertically, horizontally or at any angle required for nozzle connections.

Figure 8:
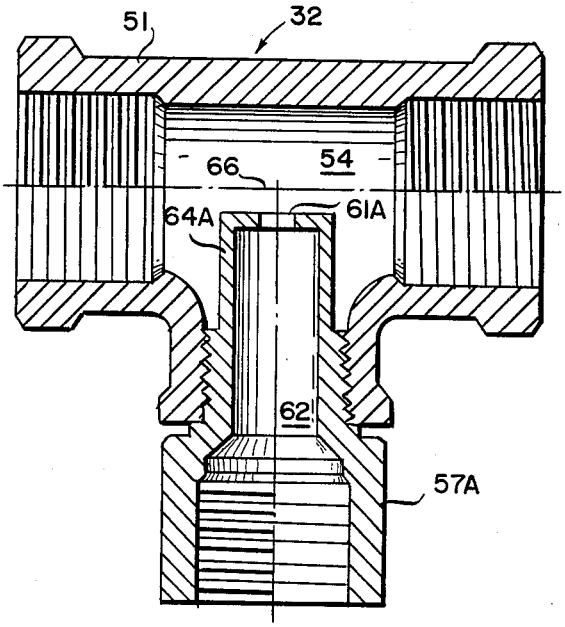
FIG. 8 shows a modified form of orifice Tee incorporating a lateral orifice facing across the axis of the manifold.

In the modified transverse orifice Tee shown in FIG. 8, the adapter nipple 57A incorporates an integral cylindrical barrel 64A extending into the continuous passageway 54 and having an orifice portal 61A formed in its end facing transversely across the axis of the passageway 54. It has been found that such transverse orifice Tees minimize the differences between and tend to equalize the volumes of powder distributed by the various Tees in the system, particularly in smaller systems such as the "ten-pound" systems designed to protect a small size area by delivering a charge of ten pounds of fire suppressant powder when required. As compared to the larger "thirty-pound" systems, these smaller ten-pound systems are more sensitive to variations in pressures, to choices of nozzles or orifices, to lengths of piping and to numbers of elbows. By equalizing orifice delivery of powder, additional nozzles may be supplied, thereby increasing the efficiency, economy and usefulness of these fire suppression systems.

It is believed that portals 61 need not face directly "upstream," but may face in almost any direction, because the charge of powder first fills the manifold completely, and is then available for delivery by the distribution orifice Tees virtually without regard to the direction their orifices face.

Figure 4:
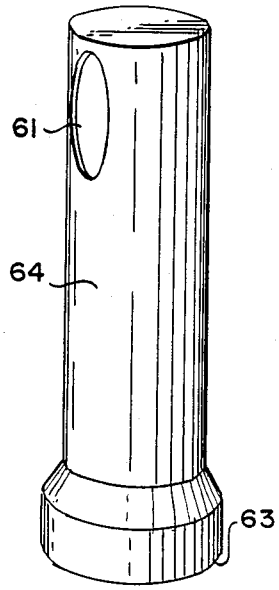
FIGS. 4 and 5 are perspective views of orifice inserts dimensioned for forced fit in the lateral outlet of the orifice Tee, and incorporating apertures of different sizes.
Figure 5:
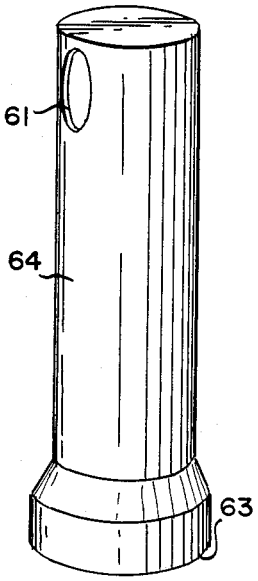
Figure 6:
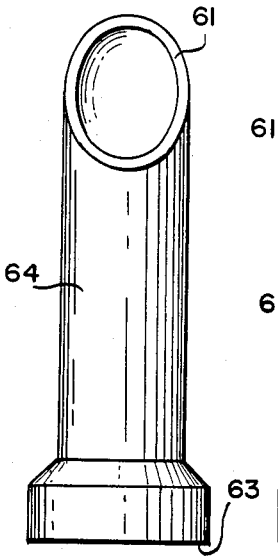
FIG. 6 is an elevation view of a different form of orifice insert.
Figure 7:
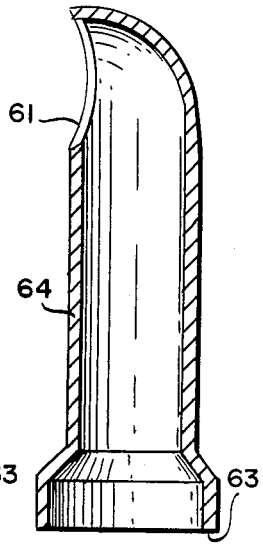
FIG. 7 is a cross-sectional, side elevation view of the orifice insert of FIG. 6.

Several different sizes of lateral entrance portal 61 are employed to provide the desired proportioning subdivision of the powder, in a given installation. Thus, FIG. 5 shows a small entrance portal 61, while FIG. 4 shows a larger entrance portal 61. The orifice insert illustrated in FIGS. 6 and 7 is generally similar to those shown in FIGS. 3, 4 and 5, but the closed end of the insert 59 of FIGS. 6 and 7 is formed with a curved radius rather than with the flat end wall illustrated in FIGS. 3, 4 and 5.

The choice of proportioning ratios offered by the different orifice inserts of this invention and by different sizes of transverse orifices in the Tee of FIG. 8, provide advantages not foreshadowed by any prior art disclosure.

One, two or more continuous non-bifurcated supply manifolds supplied by a single storage cylinder in the systems of this invention can thus deliver required volumes of dry chemical powder quickly and effectively to each desired location in industrial or commercial installations or restaurant kitchens. Redundant extra piping, Tees and subdividing are eliminated, with consequent reductions in built up powder deposits, cost and flow losses in the piping system.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A fire suppression piping system for delivering dry chemical powder propelled by compressed non-oxidizing gas upon command to quench fires in flammable liquids, such as grease fires occurring in restaurant kitchen equipment, such as grills, ovens, deep fat fryers, charbroilers, exhaust plenum hoods and exhaust ducts, which present one or more individual, potential fire hazards, each requiring a different predetermined amount of dry chemical powder to extinguish a fire therein, and providing effective and economical distribution of the amount of powder required for each potential fire hazard without costly and inefficient redundant parallel runs of duplicate piping, comprising storage cylinder means containing dry fire suppressing chemical powder and compressed nonoxidizing gas sealed therein by a valve head assembly, individual nozzle means each positioned to deliver dry chemical powder to the exposed surface of the flammable liquid, a continuous, non-bifurcated supply manifold having one end connected to the valve head assembly and its other end connected to the most remote of said nozzle means, a plurality of distribution orifice Tees, each having a through passageway connected to form an uninterrupted part of said supply manifold, a lateral outlet, and means forming a diversion orifice extending partway into said passageway and having an orifice portal of predetermined size selected to correspond to the predetermined quantity of dry chemical powder required for a specific individual fire hazard, and positioned to receive and divert said predetermined required quantity of powder from the storage cylinder and the supply manifold through the lateral outlet, and a corresponding plurality of lateral conduits each connecting one of said lateral outlets to nozzle means, delivering gas-propelled fire suppressing powder diverted by the distribution orifice Tee for ejection of its respective predetermined quantity of said powder by its nozzle means toward one said flammable liquid surface, whereby when the valve head assembly is actuated the continuous supply manifold delivers the available fire suppressing powder from the storage cylinder directly to nozzles without forked-branching and without travelling through redundant parallel runs of duplicate piping.

2. The fire suppression system defined in claim 1 wherein the orifice means is formed as an integral portion of the distribution orifice Tee.

3. The fire suppression system defined in claim 1 wherein the orifice means forms the terminal portion of a tubular insert telescopingly fitted inside the lateral outlet of the distribution orifice Tee.

4. The fire suppression system defined in claim 1 wherein the orifice means extends less than halfway into the through passageway of the distribution orifice Tee.

5. The fire suppression system defined in claim 1 wherein the valve head assembly includes actuating means responsive to an automatic heat sensor positioned above the protected area and also to a manual actuator positioned near the storage cylinder.

6. The fire suppression system defined in claim 1, including at least two continuous non-bifurcated supply manifolds, each connected to the valve head assembly.

7. The fire suppression system defined in claim 1 wherein at least one of said lateral conduits connects one of the distribution orifice Tees to at least two separate delivery nozzles, and wherein the only forked branching in the system is confined to said lateral conduits.

8. The fire suppression system defined in claim 1 wherein the orifice means incorporates a portal facing across the supply manifold in a direction transverse to the manifold's axis.

9. The fire suppression system defined in claim 1 wherein the orifice means incorporates a portal facing upstream toward the end of the manifold connected to the valve head assembly.

* * * * *